United States Patent [19]

Harsch et al.

[11] 4,327,692

[45] May 4, 1982

[54] APPARATUS FOR CONTROLLING THE DE-EXCITATION TIME OF ELECTROMAGNETIC DEVICES, IN PARTICULAR ELECTROMAGNETIC INJECTION VALVES IN INTERNAL COMBUSTION ENGINES

[75] Inventors: Klaus Harsch, Ditzingen; Peter Schülzke, Radolfzell-Stahringen, both of Fed. Rep. of Germany

[73] Assignee: Robert Bosch GmbH, Stuttgart, Fed. Rep. of Germany

[21] Appl. No.: 122,110

[22] Filed: Feb. 19, 1980

[30] Foreign Application Priority Data

Feb. 16, 1979 [DE] Fed. Rep. of Germany ..... 2905900

[51] Int. Cl.[3] ..... F02D 5/00

[52] U.S. Cl. ..... 123/490; 361/159

[58] Field of Search ..... 123/490; 361/159

[56] References Cited

U.S. PATENT DOCUMENTS 3,665,899 5/1972 Nagy ..... 123/490
3,678,298 7/1972 Dyer ..... 361/159
3,705,333 12/1972 Galletto et al. ..... 361/159
3,803,456 4/1974 Myers ..... 361/159

FOREIGN PATENT DOCUMENTS 2913576 11/1979 Fed. Rep. of Germany ..... 361/159

*Primary Examiner*—P. S. Lall
*Attorney, Agent, or Firm*—Edwin E. Greigg

[57] ABSTRACT

An apparatus is proposed for controlling the de-excitation time of electromagnetic devices, in particular electromagnetic injection valves in internal combustion engines, wherein a switch (or an actuation circuit in general) is disposed in series with the device, characterized in that a circuit arrangement with a controllable output potential is disposed in series or in parallel with the electromagnetic device. It is the purpose of the apparatus to linearize the current decrease through the electromagnetic device after the end of the actuation pulse and preferably to simultaneously control its rate of decrease. As a result, control of the de-excitation time of the particular electromagnetic device is attained. In terms of function, the circuit arrangement represents a controllable Zener diode.

4 Claims, 10 Drawing Figures

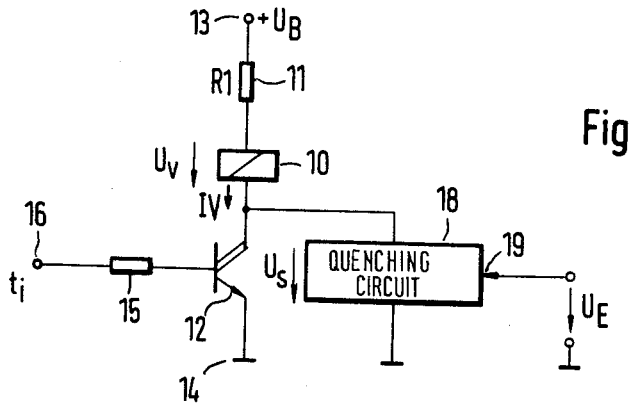
Fig.1
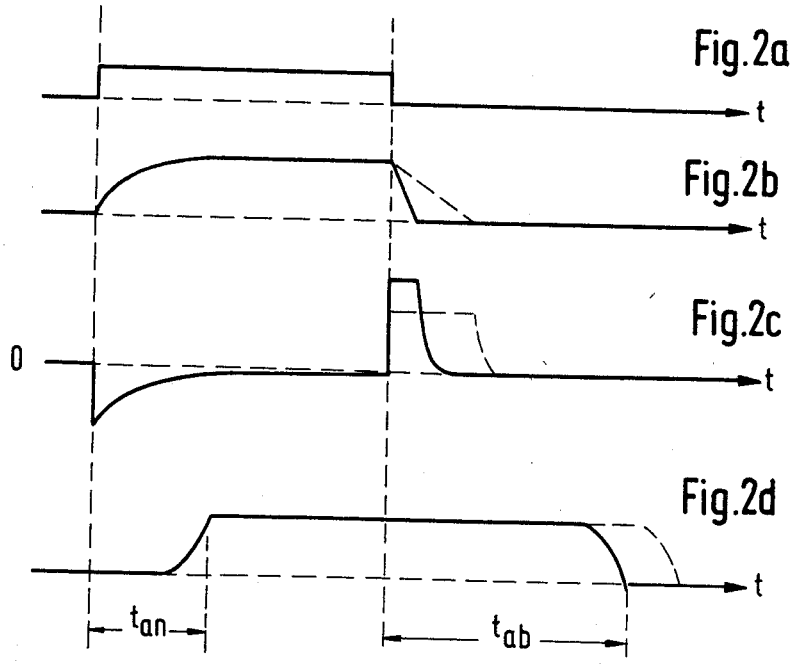

FIG. 3a
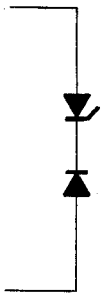
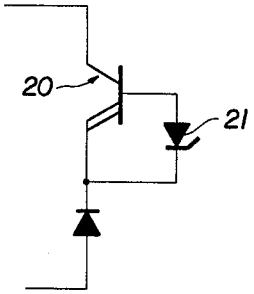
FIG. 3b
FIG. 6
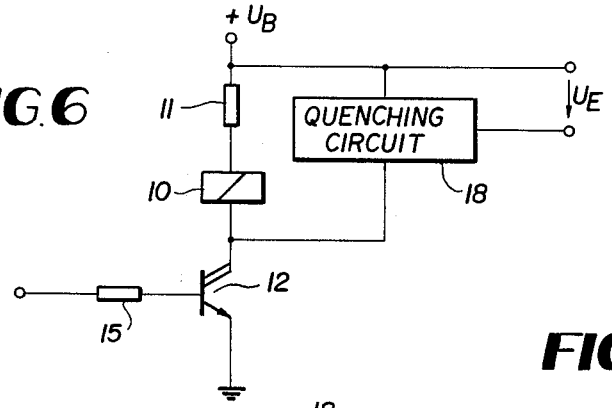
FIG. 4
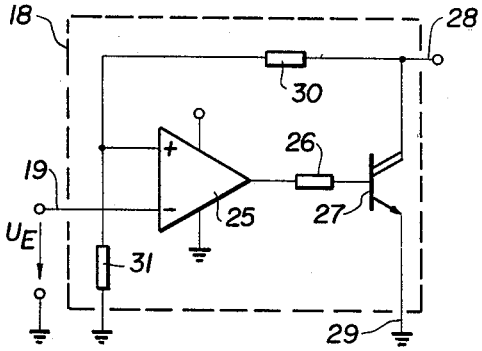
FIG. 5
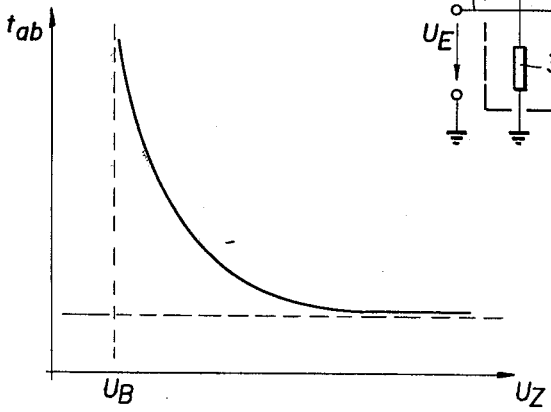

APPARATUS FOR CONTROLLING THE DE-EXCITATION TIME OF ELECTROMAGNETIC DEVICES, IN PARTICULAR ELECTROMAGNETIC INJECTION VALVES IN INTERNAL COMBUSTION ENGINES

BACKGROUND OF THE INVENTION

In order to be able to control electromagnetic devices with exact timing to the greatest possible extent, short response times and short release times are required. The response times are kept short as a rule by applying an elevated voltage to the electromagnetic device at the onset of an actuation signal. Short release or de-excitation time can be attained with a reversal of the actuation voltage, so that the smallest possible time constant is attained for the exponential response function which is a natural property of the device. If the electromagnetic device is intended to be excited for a controllable duration longer than the duration of the actual actuation signal, then the free-running circuit of the electromagnetic device can be controlled by varying a variable resistor in this free-running circuit as disclosed in the German laid-open application 20 36 655. In this known device for controlling the excitation time of the electromagnetic device beyond the duration of the input signal, however, exact times cannot be attained because of the non-linear current decrease of the electrical current flowing through the device.

OBJECT AND SUMMARY OF THE INVENTION

The apparatus according to the invention and having the characteristics of the main claim has the advantage over the known device that the de-excitation time of an electromagnetic device can be reliably controlled and thus an optimal time control is possible, for instance in electromagnetic injection valves in internal combustion engines. At the end of the actuation pulse, linear current decreases occur depending upon the corresponding initial adjustment of the apparatus, and thus there is a precisely controllable excitation of the electromagnetic device beyond the duration of the actual actuation signal.

As a result of the characteristics disclosed in the dependent claims, advantageous further embodiments for controlling the response time of electromagnetic devices are possible in a cost-favorable apparatus which is easy to manipulate.

The invention will be better understood, and further objects and advantages thereof will become more apparent from the ensuing detailed description of preferred embodiments taken in conjunction with the drawings.

BRIEF DESCRIPTION OF THE DRAWINGS

FIG. 1 illustrates an output stage of an electromagnetically actuatable injection valve in an internal combustion engine;

FIGS. *2a–2d* show pulse diagrams for explaining the subject of FIG. 1;

FIGS. *3a*, *3b* and 4 each show one example for a quenching circuit shown in FIG. 1;

FIG. 5 is a diagram showing the dependency of the release time of an electromagnetic injection valve on the quenching voltage;

FIG. 6 shows another embodiment of FIG. 1; the quenching circuit in parallel with the valve coil.

DESCRIPTION OF THE PREFERRED EMBODIMENTS

FIG. 1 shows the output stage arrangement of an electromagnetic injection valve in an internal combustion engine. The actuating winding 10 of the electromagnetic injection valve is disposed in series with a low-valued resistor 11 (which also indicates the ohmic resistance of the actuating winding) and a switching transistor 12 between the supply voltage connections 13 and 14. The switching transistor 12, resistor 15, and terminal 16 form an actuating circuit such that the switching transistor 12 is actuated via the resistor 15 by the terminal 16 at which the actuation signals for the output stage are furnished. A quenching circuit 18 is disposed parallel to the switching path of the switch 12 and receives an actuation signal $U_E$ via an input 19.

When the switching transistor 12 is switched on, for the duration of the excitation signal $t_i$ at the input 16, a constant electrical current $I\ V=(U_B-U_{CE})/R1$ flows in the resting state through the actuation winding 10 of the electromagnetic injection valve where $U_{CE}$ is the collector-emitter voltage of transistor 12. After the switching transistor 12 is blocked, a potential is present across the actuating winding 10 which is proporational to the inductivity L of this actuation winding and to the gradient over time of the electrical current decrease (di/dt). In mathematical terms, the following relationship exists:

$$U_B=R1\cdot I\ V+L\cdot(\mathrm{di}/\mathrm{dt})+U_s$$

Now, if the potential $U_s$ is held constant across the quenching circuit, an appropriate selection of $U_s$ and R1 will yield a virtually constant current gradient and the current decrease through the actuation winding 10 of the electromagnetic injection valve is linear down to very low values for electrical current. Only then can the potential $U_s$ no longer be applied by the valve-coil inductivity. Finally, $U_s$ decays as a result of eddy-current losses and so forth, in accordance with an exponential function. Because the release and de-excitation behavior of the electromagnetic injection valve is current-dependent, the rate of current decrease can be used to determine the de-excitation time of the magnetic valve beyond the duration of the actuation signal. This relationship is illustrated in FIG. 2, where FIG. *2a* shows the actuation signal of the switching transistor 12; FIG. *2b* shows the flow of electrical current through the actuation winding of the electromagnetic injection valve; FIG. *2c* shows the potential across the actuation winding 10; and, finally, FIG. *2d* shows the movement of the magnetic valve needle where $t_{an}$ and $t_{ab}$ are response and release times, respectively. It will be appreciated from FIG. *2b* that there is a different rate for the current decrease after the end of the actuation signal for the switching transistor 12, depending on the actuation signal of the quenching circuit 18 or on its constant output potential. The potential across the actuation winding 10 also remains constant, at least up to a certain time, that is until the potential across the actuation winding 10 is above that of the quenching circuit 18. FIG. *2d*, showing the movement of the injection valve needle, is highly exaggerated in terms of time for the purpose of illustration, and it also illustrates the mechanical inertia of the movable elements of the injection valve. However, it can be seen that there is a variable release time $t_{ab}$ of the valve armature shown in FIG. 2*d* with a variable slope of the current decrease as shown in FIG. 2*b*.

The invention is based on the recognition that a constant slope of the electrical current through the actuation winding 10 of the injection valve requires a constant quenching circuit output potential (at $R1 \approx 0$). In the simplest case, this quenching circuit can thus be realized by means of a Zener diode as shown in FIG. 3*a*; however, in that case no alteration of the current gradient is possible. For the case when a single Zener diode has too little capacity, the arrangement of FIG. 3*b* is recommended. There a Darlington circuit 20 has its input base coupled with the output collector by means of a Zener diode 21. The diodes of FIGS. 3*a* and 3*b* are half-wave rectifiers.

With the illustrated arrangement, the opening duration of the injection valve can be prolonged by an additive constant. This can be significant particularly when the formation of the actuation signal for the switching transistor 12 itself requires a duration which falls within the range of the intervals between pulses of the actuation signal. In this case, the actuation signal for the switching transistor 12 can then be shortened and the additive constant for holding the valve open is formed by means of the quenching circuit 18, as described below.

FIG. 4 shows a controllable quenching circuit 18 with which the gradient of the valve current decrease can be adjusted and thus the duration of the additional period of opening of the injection valve can also be adjusted. The primary component of the quenching circuit of FIG. 4 is an amplifier 25 which is followed by a transistor 27 connected via a resistor 26. The emitter-collector path of this transistor 27 is located between an output 28 and a ground connection 29. From this output 28, a voltage divider comprising the resistors 30 and 31 is connected to ground and the junction of the two resistors is coupled with the positive input of the amplifier 25; its negative input is connected directly to the input 19.

For the duration of the actuation pulse of the switching transistor 12, the potential at the output 28 of the quenching circuit 18 is very low and thus the output potential of the amplifier 25 is also very low. If the potential across the actuation winding 10 increases at the end of the $t_i$ pulse, then finally the potential at the positive input of the amplifier 25 becomes positive relative to the control potential at the input 19. The amplifier 25 begins to supply base current for the transistor 27 via the resistor 26, as a result of which the collector potential can no longer increase and the electrical current through the actuation winding 10 thus decays at a corresponding rate. If the current through the actuation winding 10 has decayed and if the potential across the resistor 31 becomes lower than the control potential $U_E$ at the control input, then the transistor 27 blocks and the entire quenching circuit 18 is in the resting state until the next injection pulse.

FIG. 5 illustrates the dependency of the valve release time $t_{ab}$ on the constant potential across the quenching circuit 18, for instance with the use of different Zener diodes. For high potential values, the component for mechanical inertia predominates over the electronic decay of current. For constant potentials of the quenching circuit 18 approaching the magnitude of the supply potential, the release time in the ideal case would tend toward infinity, because the potential across the actuation winding 10 would tend toward zero. This behavior over time in accordance with the constant potential is also illustrated by FIG. 2*c* which indicates at higher constant potentials a shorter release time is attained than at lower constant potentials.

In the exemplary embodiments described above, the de-excitation of the electromagnetic device is controlled by means of the quenching circuit 18 disposed parallel to the switching transistor 12. The quenching circuit 18 is disposed in series with the electromagnetic device when the transistor 12 is blocked.

The free-running circuit of the electromagnetic device can also be controlled in a corresponding manner, in which case the current descrease in the valve behaves in accordance with an exponential function and is then linearized in the known manner. In this case, the "quenching circuit arrangement," such as shown in FIGS. 3 and 4, is disposed parallel to the electromagnetic device. See FIG. 6.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In an internal combustion engine, a continuous control intervention apparatus for controlling the de-excitation time of an electromagnetic device having a current, comprising an actuation circuit, having a potential and first transistor, in series with and controlling an electromagnetic device, further comprising a circuit arrangement having a controllable output potential which is in series with the electromagnetic device, wherein the first transistor is connected to an actuating means which provides an external control signal to activate the first transistor;

wherein the circuit arrangement contains an amplifier and a second transistor, such that the amplifier is connected to activate the second transistor;

wherein the second transistor is connected to provide a path for the electromagnetic device current when the second transistor is activated by the amplifier; and wherein the potential of the actuation circuit is applied as an input to the amplifier and becomes adequate to make the output of the amplifier sufficient to turn on the second transistor on non-actuation of the actuation circuit.

2. In an internal combustion engine, an apparatus in accordance with claim 1, wherein the circuit arrangement controls a current gradient of the electromagnetic device.

3. In an internal combustion engine, a continuous control intervention apparatus for controlling the de-excitation time of an electromagnetic device having a current, comprising an actuation circuit, having a potential and first transistor, in series with and controlling an electromagnetic device, further comprising a circuit arrangement having a controllable output potential which is in parallel with the electromagnetic device.

wherein the first transistor is connected to an actuating means which provides an external control signal to activate the first transistor;

wherein the circuit arrangement contains an amplifier and a second transistor, such that the amplifier is connected to activate the second transistor;

wherein the second transistor is connected to provide a path for the electromagnetic device current when the second transistor is activated by the amplifier; and wherein the potential of the actuation circuit is applied as an input to the amplifier and becomes adequate to make the output of the amplifier sufficient to turn on the second transistor on non-actuation of the actuation circuit.

4. In an internal combustion engine, an apparatus in accordance with claim 3, wherein the circuit arrangement controls a current gradient of the electromagnetic device.

* * * * *